US010103456B1

(12) United States Patent
Afdasta et al.

(10) Patent No.: US 10,103,456 B1
(45) Date of Patent: Oct. 16, 2018

(54) ELECTRICA SPRING-TERMINAL

(71) Applicant: AFC Cable Systems, Inc., New Bedford, MA (US)

(72) Inventors: Skip N. Afdasta, Coventry, RI (US); Eugene J. Ellis, Taunton, MA (US)

(73) Assignee: AFC Cable Systems, Inc., New Bedford, MA (US)

( * ) Notice: Subject to any disclaimer, the term of this patent is extended or adjusted under 35 U.S.C. 154(b) by 0 days.

(21) Appl. No.: 15/606,036

(22) Filed: May 26, 2017

(51) Int. Cl.
*H01R 4/48* (2006.01)
*H01R 11/11* (2006.01)

(52) U.S. Cl.
CPC ..... *H01R 4/4818* (2013.01); *H01R 11/11* (2013.01)

(58) Field of Classification Search
CPC ..... H01R 4/4818; H01R 4/36; H01R 11/11; H01R 13/112; H01J 5/48
USPC ..... 439/839
See application file for complete search history.

(56) References Cited

U.S. PATENT DOCUMENTS 7,070,463 B2 * 7/2006 Arai ..... H01R 4/4818 439/276
2001/0015606 A1 * 8/2001 Arakawa ..... H01J 5/48 313/318.01
2004/0121639 A1 * 6/2004 Yaworski ..... H01R 4/36 439/276
2005/0181681 A1 * 8/2005 Arai ..... H01R 4/4818 439/787
2012/0264340 A1 * 10/2012 Mueller ..... H01R 13/112 439/861

* cited by examiner

*Primary Examiner* — Jean F Duverne

(57) ABSTRACT

Embodiments herein are directed to a wire spring terminal including a main contact body having a base and a set of sidewalls defining a central cavity, a first spring contact extending from the base into the central cavity, and a second spring contact extending from one of the sidewalls into the central cavity, wherein the first and second spring contacts are configured to engage a wire inserted into the main contact body. In some embodiments, the wire spring terminal includes a third spring contact extending from the base into the central cavity, and a fourth spring contact extending from another one of the set of sidewalls into the central cavity, the third and fourth spring contacts configured to engage a wire. The first and third spring contacts may be arranged side-by-side, separated by a slot. The second and fourth spring contacts are also arranged side-by-side, separated by another slot.

20 Claims, 8 Drawing Sheets

ELECTRICA SPRING-TERMINAL

FIELD

The present invention relates generally to electrical contact terminals and, more particularly, to a one-piece push-in electrical spring contact terminal.

BACKGROUND

Wire connection terminals are mainly used to connect the electrical wires between electronic components or to connect the wire contacts of the electronic components onto a circuit board. The electronic components may include resistors, capacitors, inductors, LEDs, transformers, liquid crystal panels, touch panels, etc. Accordingly, the wire connection terminal serves to transmit power or electronic signals to facilitate layout and service of the internal circuit boards and electronic components of the electronic products and apparatuses.

There are many different types of electrical connectors for use in lighting fixtures that are capable of being easily connected and disconnected. Electrical connectors may have a terminal assembly for making an electrical connection via push-in termination with a conductor of a stripped end of a wire. Such electrical connectors may provide a connection to one or more additional conductors of stripped ends of wires, a printed circuit board, and/or another electrical apparatus.

Many electrical connectors permit safely de-energizing or removing an electrical component from a circuit (power or ground) so that it may be serviced. During removal, tension on the wire(s) instead of the connector may weaken the connection between the wire and the electrical contact within the connector. In some cases, the wire is therefore soldered or crimped to the contact. In other cases the wire is simply inserted into an insulation displacement contact or pushed into the connector. Such separation of the wire from the contact terminal may render the connector unusable, leading to increased material and labor costs.

With respect to these and other considerations the present disclosure is provided.

BRIEF SUMMARY

A wire spring terminal according to a first embodiment of the present disclosure may include a main contact body having a base and a set of sidewalls defining a central cavity, the sidewalls oriented substantially perpendicularly to the base. The wire spring terminal may further include a first spring contact extending from the base into the central cavity, and a second spring contact extending from one of the set of sidewalls into the central cavity, wherein the first and second spring contacts are configured to engage a wire inserted into the central cavity.

A wire spring terminal according to a second embodiment of the present disclosure may include a main contact body having a base and a set of sidewalls defining a central cavity, the sidewalls oriented substantially perpendicularly to the base. The wire spring terminal may further include a first spring contact extending from the base into the central cavity, and a second spring contact extending directly from an upper end of one of the set of sidewalls into the central cavity, wherein the first and second spring contacts are configured to engage a wire inserted into the central cavity.

A wire spring terminal for an electrical connector according to a third embodiment of the present disclosure may include a main contact body having a base and a set of sidewalls defining a central cavity, the sidewalls oriented substantially perpendicularly to the base. The wire spring terminal may further include a first spring contact extending from the base into the central cavity, and a second spring contact extending from one of the set of sidewalls into the central cavity. The first and second spring contacts are configured to engage a wire inserted into the central cavity, wherein the second spring contact includes a shoulder region extending from the upper end of the one of the set of sidewalls, and an upper wall extending from the one of the set of sidewalls. The upper wall may be oriented substantially parallel to the base of the main contact body, and substantially perpendicular to the one of the set of sidewalls. The second contact spring further includes a free end portion cantilevered from the upper wall at an angle into the central cavity.

BRIEF DESCRIPTION OF THE DRAWINGS

The accompanying drawings illustrate example approaches of the disclosure, including the practical application of the principles thereof, as follows.

Figure 1:
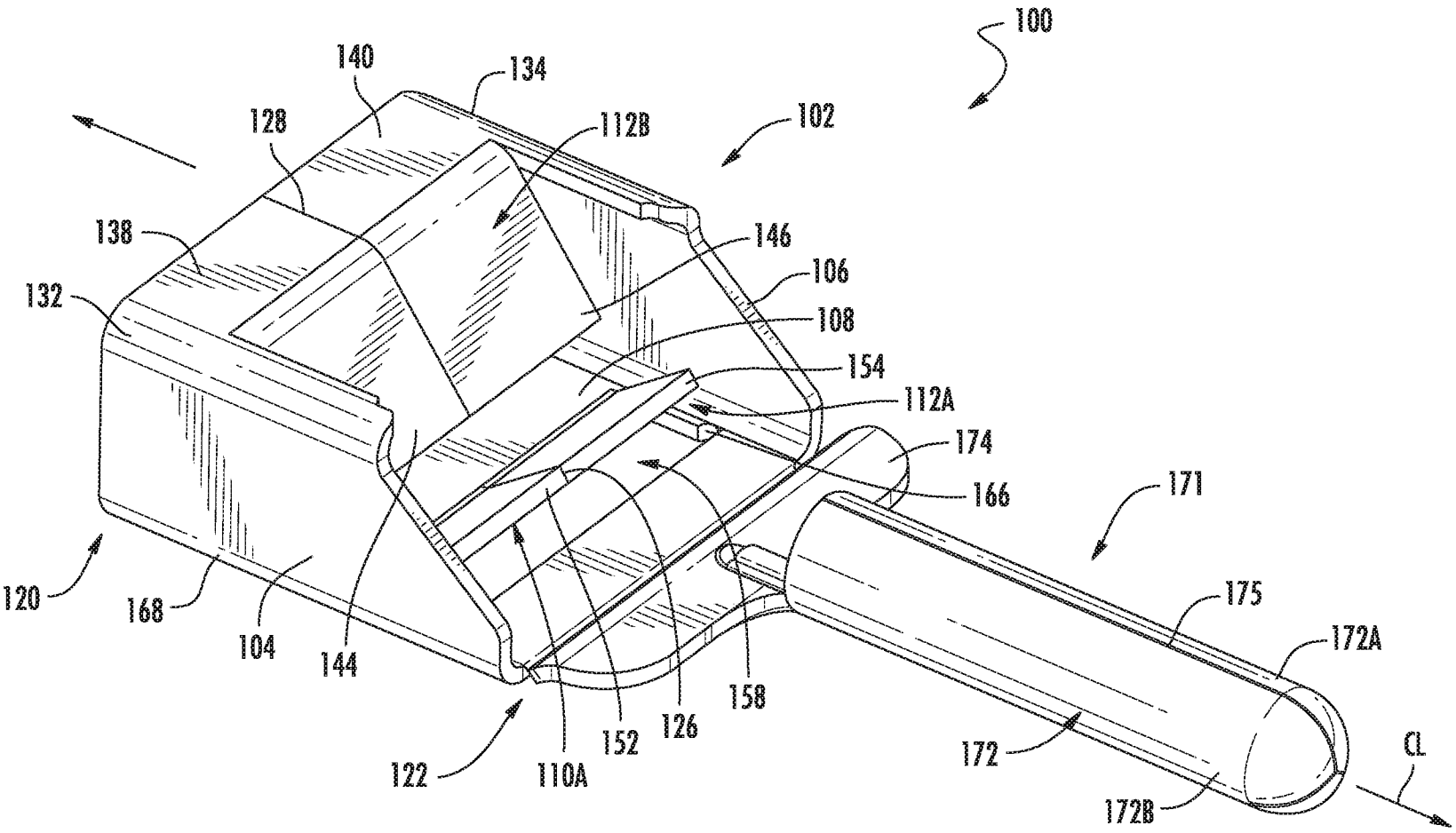
FIG. 1 depicts a perspective view of an example wire spring terminal according to embodiments of the disclosure.
Figure 2:
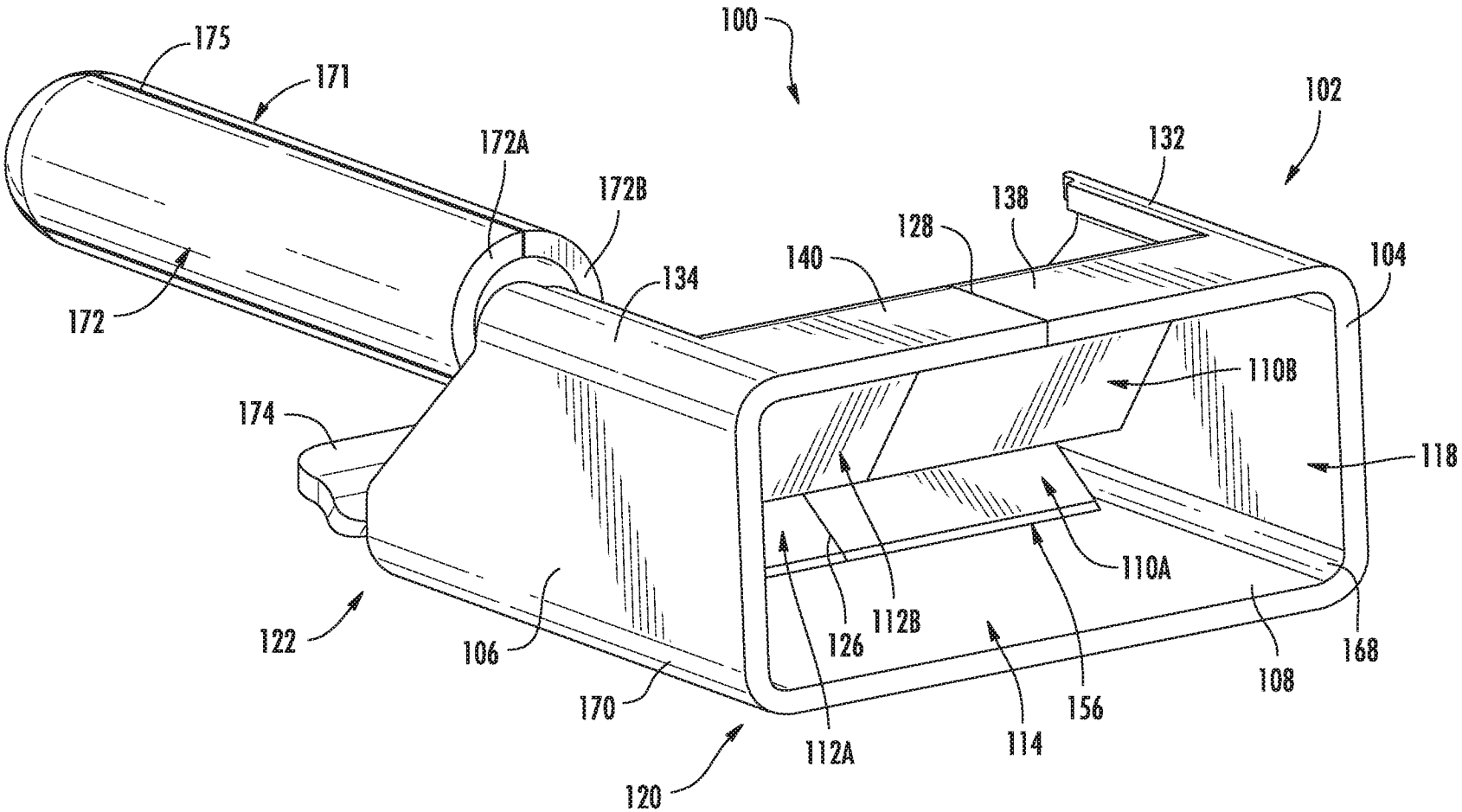
FIG. 2 depicts a perspective view of an example wire spring terminal according to embodiments of the disclosure.
Figure 3:
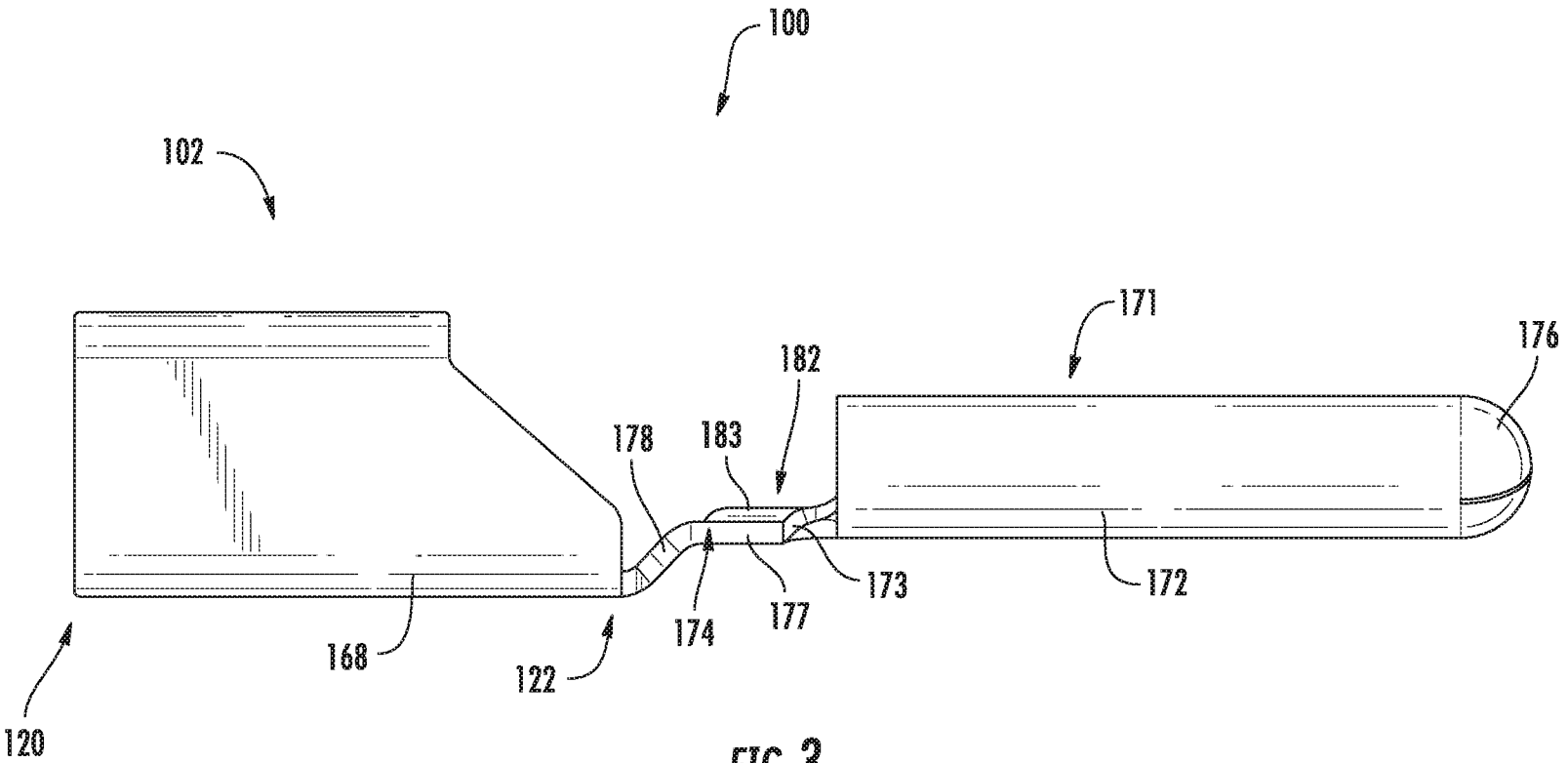
FIG. 3 depicts a side view of an example wire spring terminal according to embodiments of the disclosure.
Figure 4:
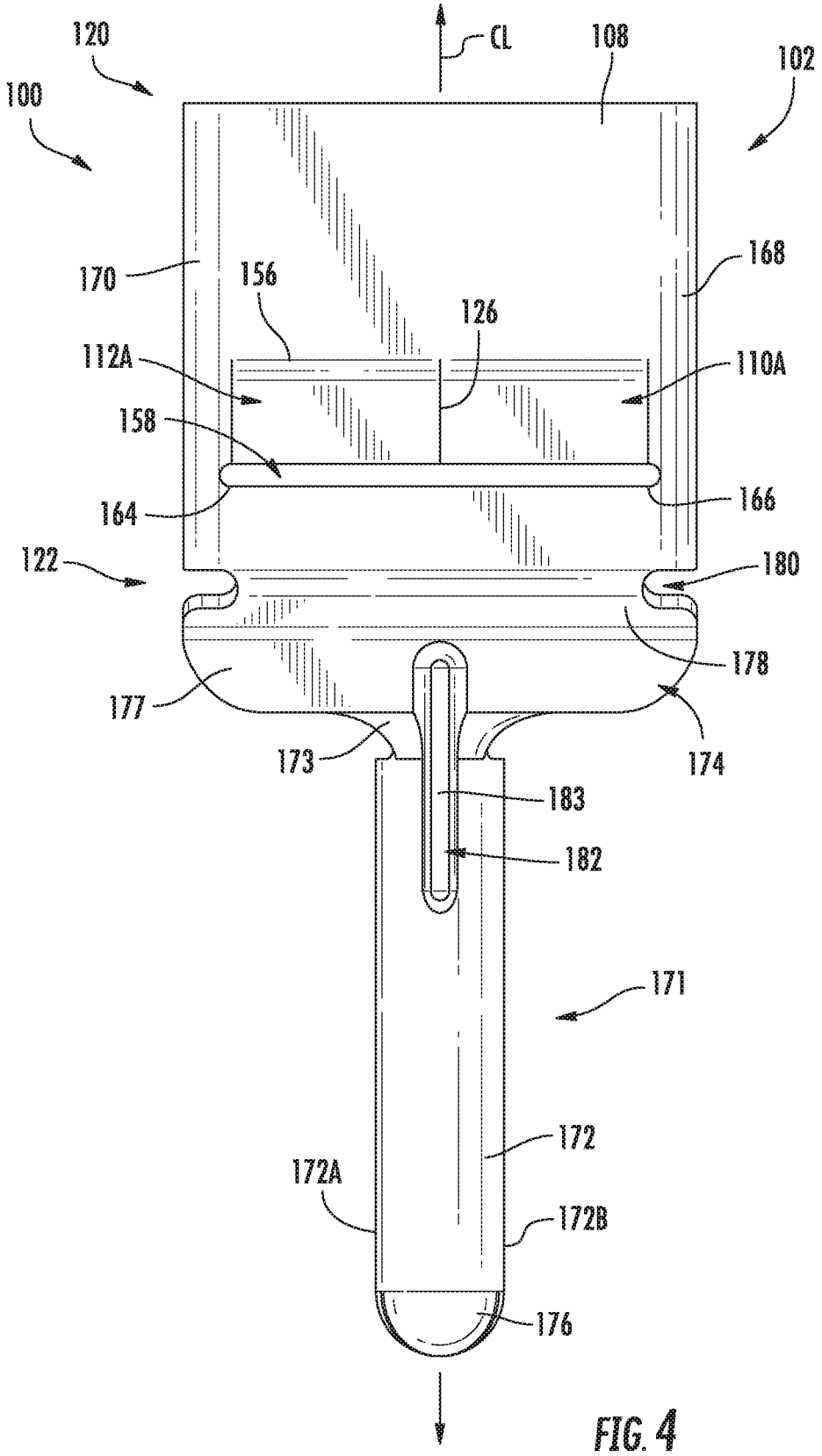
FIG. 4 depicts a bottom view of an example wire spring terminal according to embodiments of the disclosure.

The drawings are not necessarily to scale. The drawings are merely representations, not intended to portray specific parameters of the disclosure. The drawings are intended to depict example embodiments of the disclosure, and therefore are not be considered as limiting in scope. In the drawings, like numbering represents like elements.

DETAILED DESCRIPTION

The present embodiments will now be described more fully hereinafter with reference to the accompanying drawings, where some embodiments are shown. The subject matter of the present disclosure may be embodied in many different forms and are not to be construed as limited to the embodiments set forth herein. These embodiments are provided so this disclosure will be thorough and complete, and will fully convey the scope of the subject matter to those skilled in the art. In the drawings, like numbers refer to like elements throughout.

As used herein, an element or operation recited in the singular and proceeded with the word "a" or "an" are understood as possibly including plural elements or operations, except as otherwise indicated. Furthermore, various embodiments herein have been described in the context of one or more elements or components. An element or component may comprise any structure arranged to perform certain operations. Although an embodiment may be described with a limited number of elements in a certain topology by way of example, the embodiment may include more or less elements in alternate topologies as desired for a given implementation. Note any reference to "one embodiment" or "an embodiment" means a particular feature, structure, or characteristic described in connection with the embodiment is included in at least one embodiment. The appearances of the phrases "in one embodiment," "in some embodiments," and "in various embodiments" in various places in the specification are not necessarily all referring to the same embodiment.

Embodiments described and/or illustrated herein may provide electrical spring contacts of a terminal having a wire interface that can be disengaged from an electrical wire. The embodiments described and/or illustrated herein may provide electrical spring contacts that enable an electrical wire to be inserted into and/or removed from a receptacle multiple times without damaging the electrical wire and/or the electrical contact. The embodiments described and/or illustrated herein may provide electrical spring contacts that can accommodate a greater range of different wire sizes than at least some known wire spring terminals.

Described herein are improvements over current art contact springs and terminals, which are made of two separate parts. Current art approaches employ three (3) holes in the front of the terminal for insertion of different size wires (18 ga-12 ga) therein. Current art approaches also have three (3) cantilever springs at an opposite side, each of the springs bending down on the terminal to grip hold wires on the terminal. The wire spring terminal of the present disclosure is generally manufactured from a single piece of electrically conductive material, and may be generally punched out from a larger sheet of material, and then rolled or bent or otherwise configured into the desired shape. The spring terminal has a pin or a receptacle at one end. At an opposite end, the spring terminal has springs contacts, which bend up for from a base of a main contact body, and springs that extend from an upper part of the sidewalls defining the main contact body. Each of the spring is cantilevered, and arranged to engage opposite sides of a wire (e.g., 10 ga) inserted therebetween.

The present embodiments are directed a wire spring terminal including a main contact body having a base and a set of sidewalls defining a central cavity, a first spring contact extending from the base into the central cavity, and a second spring contact extending from one of the set of sidewalls into the central cavity, wherein the first and second spring contacts are configured to engage a wire inserted into the main contact body. In some embodiments, the wire spring terminal includes a third spring contact extending from the base into the central cavity, and a fourth spring contact extending from another one of the set of sidewalls into the central cavity, the third and fourth spring contacts configured to an additional wire, which may have a different gauge, inserted into the main contact body. The first and third spring contacts may be arranged side-by-side, separated by a slot or gap. The second and fourth spring contacts are also arranged side-by-side, separated by another slot or gap. As configured, the wire spring terminal is a unitary, one-piece push-in electrical spring contact terminal suitable to accept and retain wires in the range of 18 ga-10 ga.

The spring contacts are of resilient construction, such as in the form of a spring member, and are configured so that when compressed by the wire inserted into the main contact body, the spring contacts allow for insertion of the conductor with reduced insertion force. Once the wire is fully inserted within the internal cavity of the main contact body, the spring contacts engage opposite sides/surfaces of an exposed portion of the wire, such that removal of the wire is resisted.

Referring now to FIGS. 1-4, an example wire spring terminal (hereinafter "terminal") 100 will be described in greater detail. As shown, the terminal 100 may be an electrical contact terminal for an electrical connector used for coupling modular electrical wiring to an electrical fixture. The terminal 100 may be made from a unitary piece of electrically conductive material, and includes one or more pairs of spring contacts 110A-B and 112A-B that angle towards one another to engage and retain a wire (not shown) therebetween, as will be described in greater detail below. The terminal 100 is generally made of a metal material having electrical conductivity.

As shown, the terminal 100 includes a main contact body 102 and a set of opposing sidewalls 104, 106 extending perpendicularly from a base 108. The base 108 and the set of opposing sidewalls 104, 106 may form the shape of a rectangular box, which defines a central cavity 114 and an end opening 118 for receiving a wire therein. In some embodiments, the opposing sidewalls 104, 106 may extend a length of the main contact body 102, between a first end 120 and a second end 122. The opposing sidewalls 104, 106 may be spaced apart by a distance such that multiple wires can be inserted into the central cavity 114. In some embodiments, the terminal may accept and retain wires in the range of 10 ga-18 ga.

The main contact body 102 and the pairs of spring contacts 110A-B and 112A-B may each be fabricated from copper, gold, silver, aluminum, nickel, platinum, stainless steel, and/or the like. Optionally, the main contact body 102 and/or the pairs of spring contacts 110A-B, 112A-B may include a base material that is coated (e.g., plated and/or the like) with one or more different materials. For example, fabricating the pairs of spring contacts 110A-B, 112A-B and/or other portions of the main contact body from one or more metallic materials may prevent damage to the from heat or extended operation.

As further shown, the terminal 100 includes a first spring contact 110A extending from the base 108 into the central cavity 114, and a second spring contact 110B extending from sidewall 104 into the central cavity 114. Similarly, a third spring contact 112A extends from the base 108 into the central cavity 114, and a fourth spring contact 112B extends from sidewall 106. In some embodiments, the first spring contact 110A and the third spring contact 112A are arranged side-by-side, separated by a first slot 126, which may be a gap or opening. The first spring contact 110A and the third spring contact 112A may extend generally along the same plane, as shown, or may extend at different angles towards the base 108 relative to one another to accommodate for different wire sizes and or varied gripping force. The second spring contact 110B and the fourth spring contact 112B are similarly arranged side-by-side, and separated by a second slot 128, which may be a gap or opening. The second spring contact 110B and the fourth spring contact 112B may extend generally along the same plane, as shown, or may extend at different angles into the central cavity 114 relative to one another. The first and second slots 126, 128 permit individual movement/operation of each pair of spring contacts 110A-B and 112A-B. In some embodiments, each of the pairs of spring contacts 110A-B and 112A-B is generally flat and has a uniform thickness. In other embodiments, one or more contacts from the pairs of spring contacts 110A-B and 112A-B may be curved and/or have a varied geometry.

As further shown, the second and fourth spring contacts 110B, 112B extend from respective shoulder sections 132, 134 of the opposing sidewalls 104, 106. In some embodiments, the second and fourth spring contacts 110B, 112B include respective upper walls 138, 140 extending from the shoulder sections 132, 134. The upper walls 138, 140 extend towards a centerline 'CL,' and are oriented parallel, or substantially parallel, to the base 108 of the main contact body 102. The upper walls 138, 140 are oriented perpendicular, or substantially perpendicular, to the opposing sidewalls 104, 106. As shown, the upper walls 138, 140 meet centrally between the opposing sidewalls 104 and 106, partially defining the second slot 128.

The second and fourth spring contacts 110B, 112B further include respective free ends 144, 146 extending from the upper walls 138, 140. As shown, the free ends 144, 146 extend at an angle into the central cavity 114 and towards the first and third spring contacts 110A, 112A. In some embodiments, the free ends 144, 146 are cantilevered with respect to the upper walls 138, 140 and the opposing sidewalls 104, 106. Each of the second and fourth spring contacts 110B, 112B is elastically deformable and configured to provide a downward force to a wire inserted into the central cavity 114.

The first and third spring contacts 110A, 112A extend upward from a central section of the base 108 towards shoulder sections 132, 134. Specifically, free ends 152, 154 of respective first and third spring contacts 110A, 112A extend into the central cavity 114 at an angle relative to the base 108. In some embodiments, the free ends 144, 146 are cantilevered with respect to the base 108. Each of the first and third spring contacts 110A, 112A is elastically deformable and configured to provide an upward force to a wire inserted into the central cavity 114.

As shown, the first and third spring contacts 110A, 112A may extend from an edge 156 of an opening 158 formed through the base 108 of the main contact body 102. In one embodiment, the opening 158 includes a pair of notches 164, 166 (FIG. 4) formed adjacent respective lower shoulders 168, 170 of the opposing sidewalls 104, 106. The notches 164, 166 may be part of a slot extending between opposing sidewalls 104, 106, wherein the slot is machined as part of a process to form a series of slits in the base 108 having appropriate lengths to form the first and third spring contacts 110A, 112A by a subsequent machining step (e.g., mechanical punching).

The terminal 100 further includes a connection member 171 extending outwardly from the second end 122 of the main contact body 102. In various embodiments, the connection member 171 may be a pin member or a terminal connector. In the embodiment shown, the connection member represents a pin member. For example, the connection member 171 may include a tubular section 172 extending along centerline 'CL,' and a neck region 173 connecting the tubular section 172 to a tongue 174. In some embodiments, the connection member 171 represents a pin that may be inserted into a socket (not shown). The tubular section 172 may include first and second sides 172A-B bent towards each other. For example, the first and second sides 172A-B may be curved so as to meet along intersection 175. As further shown, the connection member 171 may include an end cap 176 disposed at the tip of the tubular section 172. In some embodiments, the end cap 176 includes three (3) complementary triangular sections arranged together to form a circular dome shape. In yet other embodiments, the tubular section 172 does not include an end cap. Instead, the tubular section 172 is open along each end, and represents a terminal connector.

The tubular section 172 is joined to the tongue 174 by the neck region 173, which widens at an intersection with the tongue 174. In some embodiments, as better shown in FIGS. 3-4, the tongue 174 may include a first section 177 adjacent the neck region 173, and a second region 178 adjacent the base 108. As shown, the second region 178 may include one or more side cutouts 179, 180 to relieve strain and to enable bending or curving of the second region 178. In some embodiments, the stepped second region 178 causes the first section 177 to extend along a plane that is offset but parallel to a plane defined by an upper surface of the base 108 of the main contact body 102.

In some embodiments, the connection member 171 may further include a support member 182 extending between the tubular section 172 and the tongue 174. The support member 182 provides strength and rigidity to the neck region 173 and the tubular section 172. As shown, the support member 182 may include a stiffening feature such as a ridge 183 extending from the first section 177, across the neck region 173, and into to the tubular section 172. In some embodiments, the ridge 183 extends outwardly (e.g., upwards in the orientation of FIG. 3) from a top surface of each of the first section 177, the neck region 173, and the tubular section 172. Along an underside of the connection member 171, the ridge 183 may extend into the first section 177 and the tubular section 172 to form a recess or trough therein. In some embodiments, the ridge 183 may be stamped into the terminal 100. It will be appreciated however, that various other types of stiffening features may alternatively be used to provide structural support between the main contact body 102 and the connection member 171.

Figure 5:
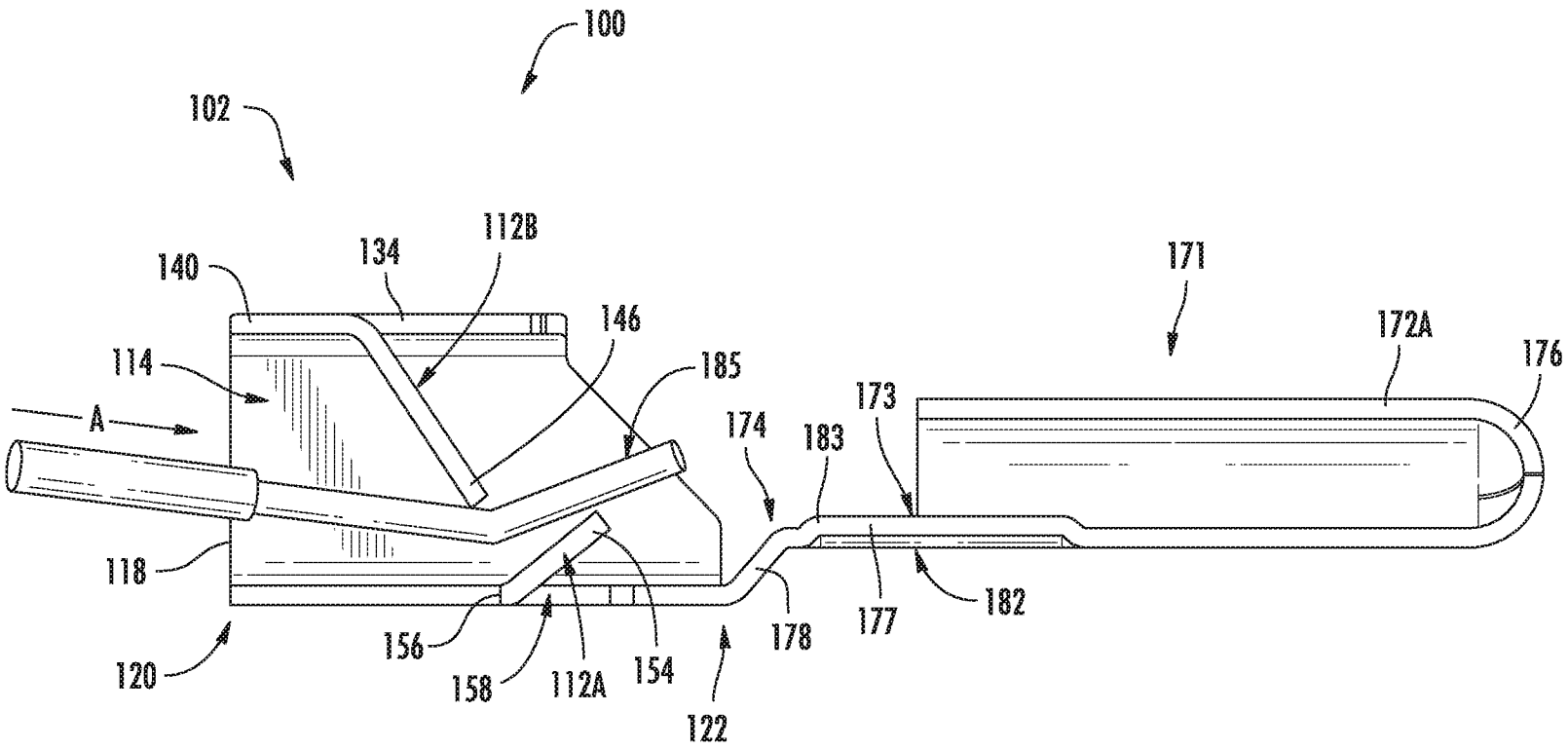
FIG. 5 depicts a side cross-sectional view of an example wire spring terminal according to embodiments of the disclosure.

Turning now to FIG. 5, operation of the terminal 100 will be described in greater detail. As shown, the pair of spring contacts 112A-B may contact opposite sides of an uninsulated/exposed portion of the wire 185 that is inserted in a direction along arrow 'A' through the end opening 118 and towards the second end 122 of the main contact body 102. As oriented in FIG. 5, the third spring contact 112A extends upwards at an angle, while the fourth spring member 112B extends downwards at an angle, thus forming an opening between the pair of spring contacts 112A-B. In the embodiment shown, the spring contacts 112A-B extend at an angle towards the second end 122 of the main contact body 102 to permit the wire 185 to be more easily inserted therebetween. The opening between the pair of spring contacts 112A-B has a dimension that is slightly smaller than the diameter of the uninsulated/exposed portion of the wire 185 so that as the wire 185 is inserted, the pair of spring contacts 112A-B are forced apart. Once the wire 185 is inserted, the return bias force of each spring contact 112A-B locks the wire 185 in place so that the wire 185 cannot be easily disengaged from the main contact body 102. In some embodiments, each spring contact 112A and 112B may have an angled or sharpened edge to better grip or dig into the wire 185.

Figure 6:
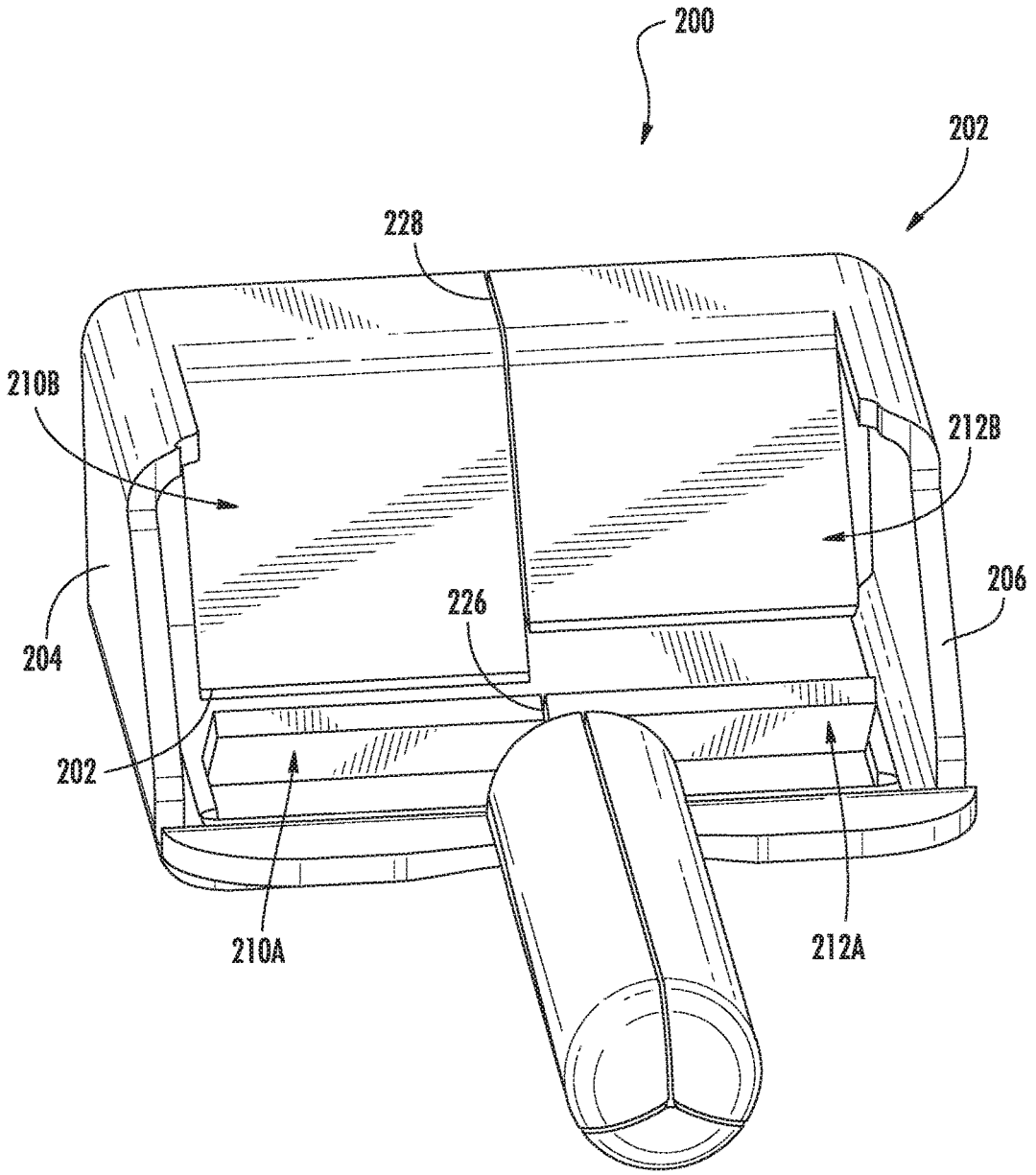
FIG. 6 depicts a perspective view of an example wire spring terminal according to embodiments of the disclosure.

Referring now to FIG. 6, an example wire spring terminal 200 will be described in greater detail. As shown, the terminal 200 may be an electrical contact terminal for an electrical connector used for coupling modular electrical wiring to an electrical fixture. The terminal 200 may be made from a unitary piece of electrically conductive material, and includes one or more pairs of spring contacts 210A-B and 212A-B that angle towards one another to engage and retain a wire (not shown) therebetween, as will be described in greater detail below. As shown, the terminal 200 includes many or all of the features previously described in relation to the terminal 100 of FIGS. 1-5. As such, just certain aspects of the terminal 200 will hereinafter be described for the sake of brevity.

As shown, the terminal 200 includes a first spring contact 210A extending from the base 208 into the central cavity 214, and a second spring contact 210B extending from sidewall 204 into the central cavity 214. Similarly, a third spring contact 212A extends from the base 208 into the central cavity 214, and a fourth spring contact 212B extends from sidewall 206. In some embodiments, the first spring contact 210A and the third spring contact 212A are arranged side-by-side, separated by a first slot 226. The first spring contact 210A and the third spring contact 212A may extend generally along the same plane, as shown, or may extend at different angles towards the base 208 relative to one another to accommodate for different wire sizes and or varied gripping force. The second spring contact 210B and the fourth spring contact 212B are similarly arranged side-by-side, and separated by a second slot 228. The second spring contact 210B and the fourth spring contact 212B may extend generally along the same plane, as shown, or may extend at different angles into the central cavity 214 relative to one another. The first and second slots 226, 228 permit individual movement/operation of each pair of spring contacts 210A-B and 212A-B.

In some embodiments, each of the pairs of spring contacts 210A-B and 212A-B is generally flat and has a uniform thickness. In other embodiments, one or more contacts from the pairs of spring contacts 210A-B and 212A-B may be curved and/or have a varied geometry. In yet other embodiments, one or more contacts from the pairs of spring contacts 210A-B and 212A-B has a different length to accommodate for multiple wires of varying thicknesses. For example, as shown, the second contact spring 210B is longer than the fourth contact spring 212B. As a result, the distance between the free end 252 of the second contact spring 210B and the first contact spring 210A is reduced, rendering the opening for the wire to pass through smaller than the opening between the second pair of contact springs 212A-B. During use, wires with a smaller diameter may be inserted through the first pair of spring contacts 210A-B, while wires with a larger diameter may be inserted through the second pair of spring contacts 212A-B.

Figure 7:
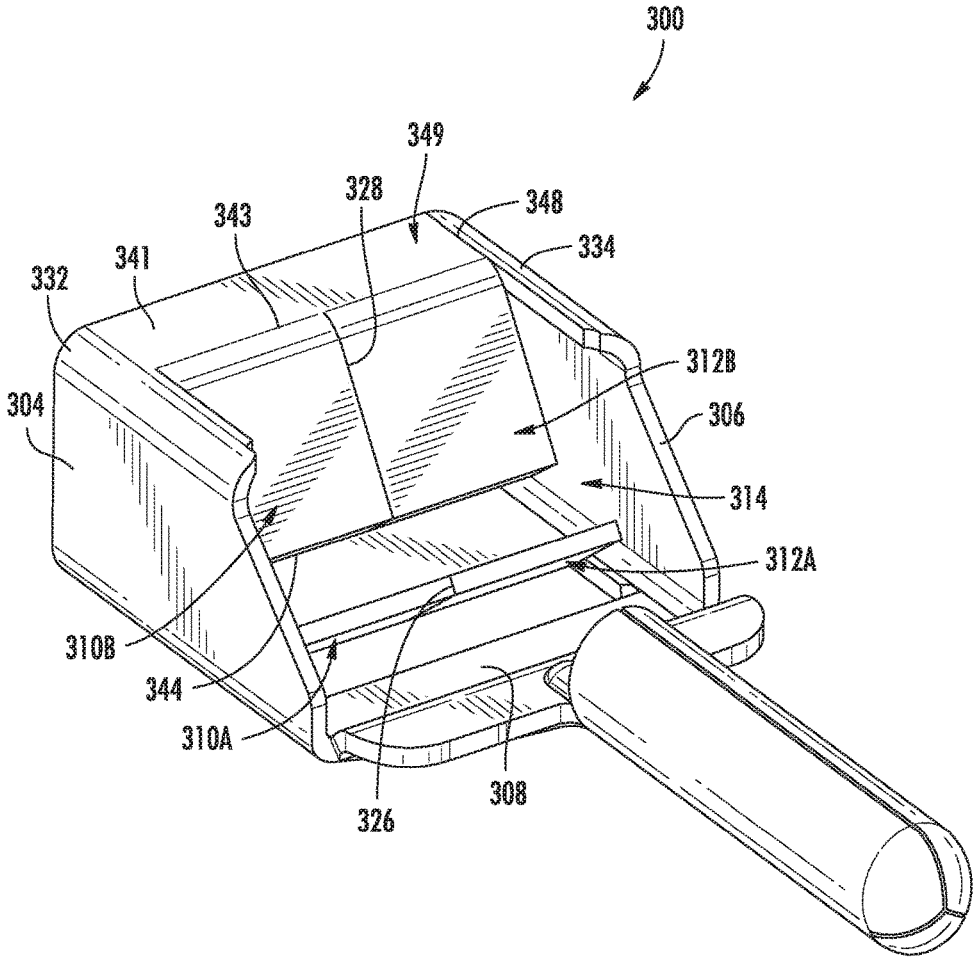
FIG. 7 depicts a perspective view of an example wire spring terminal according to embodiments of the disclosure.

Referring now to FIG. 7, an example wire spring terminal 300 will be described in greater detail. As shown, the terminal 300 may be an electrical contact terminal for an electrical connector used for coupling modular electrical wiring to an electrical fixture. The terminal 300 includes many or all of the features previously described above in relation to terminals 100 and 200. As such, just certain aspects of the terminal 300 will hereinafter be described for the sake of brevity.

As shown, the terminal 300 includes a first spring contact 310A extending from the base 308 into the central cavity 314, and a second spring contact 310B extending from sidewall 304 into the central cavity 314. Similarly, a third spring contact 312A extends from the base 308 into the central cavity 314, and a fourth spring contact 312B extends from sidewall 306. In some embodiments, the first spring contact 310A and the third spring contact 312A are arranged side-by-side, separated by a first slot 326. The first spring contact 310A and the third spring contact 312A may extend generally along the same plane, as shown, or may extend at different angles towards the base 308 relative to one another to accommodate for different wire sizes and or varied gripping force. The second spring contact 310B and the fourth spring contact 312B are similarly arranged side-by-side, and separated by a second slot 328. The second spring contact 310B and the fourth spring contact 312B may extend generally along the same plane, as shown, or may extend at different angles into the central cavity 314 relative to one another. The first and second slots 326, 328 permit individual movement/operation of each pair of spring contacts 310A-B and 312A-B.

In this embodiment, the second and fourth spring contacts 310B, 312B extend from an upper wall 341, which may be a contiguous component or piece of material extending from the shoulder section 332 of the sidewall 304 towards the sidewall 306. As shown, the second and fourth spring contacts 310B, 312B may extend downwards from an inner edge 343 of the upper wall 341, wherein free ends 344, 346 are cantilevered with respect to the upper wall 341. In the non-limiting embodiment shown, the second slot 328 extends between the inner edge 343 and the respective free ends 344 and 346 of second and fourth spring contacts 310B and 312B. By extending the second slot 328 only to the inner edge 343, as opposed to entirely through the upper wall 341, the second and fourth spring contacts 310B, 312B may have increased rigidity. In some embodiments, as shown, a third slot 348 may be provided between a free end 349 of the upper wall 341 and the upper shoulder 334 of the sidewall 306, wherein the third slot 348 may represent a space or gap. The upper wall 341 and the fourth spring contact 312B are not in direct physical contact with the sidewall 306. Instead, the upper wall 341 may be cantilevered from the shoulder section 332.

Figure 8:
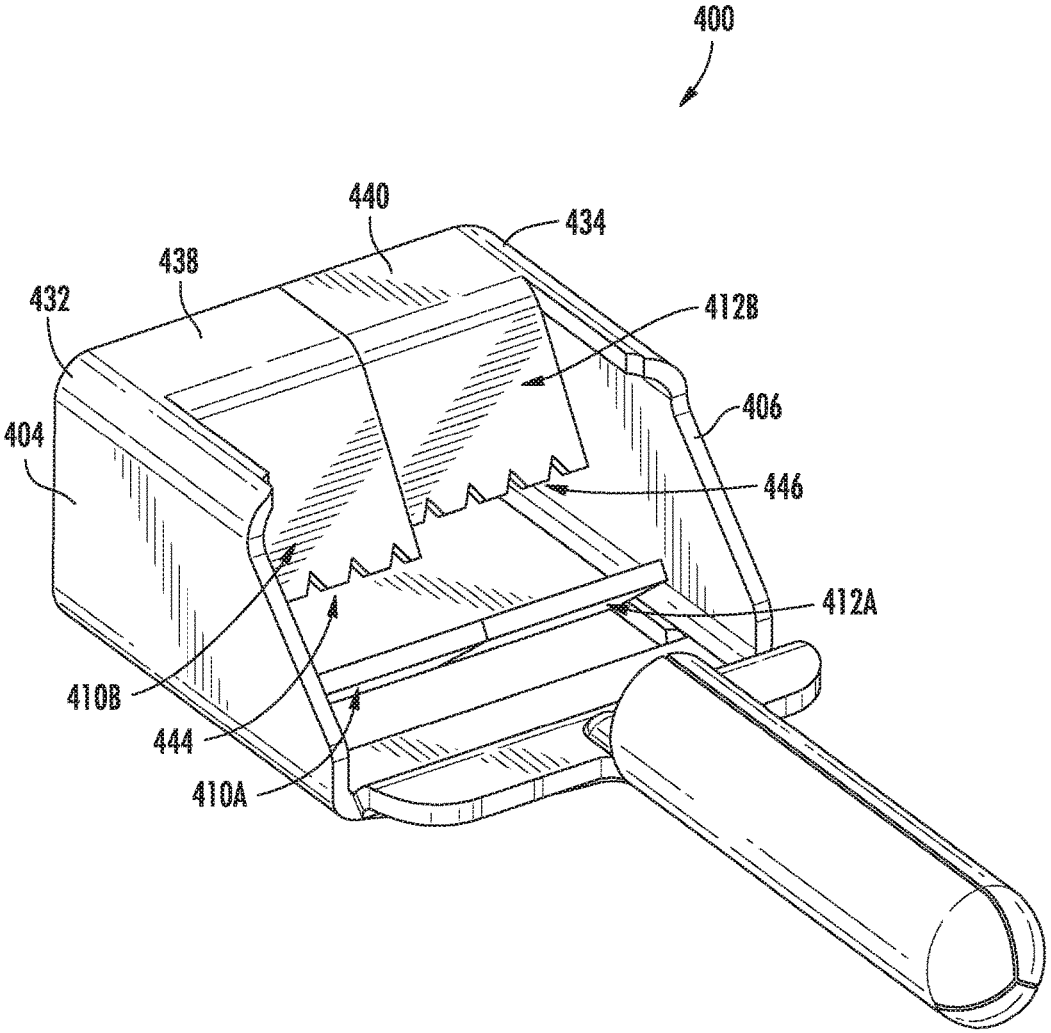
FIG. 8 depicts a perspective view of an example wire spring terminal according to embodiments of the disclosure.

Referring now to FIG. 8, an example wire spring terminal 400 will be described in greater detail. As shown, the terminal 400 may be an electrical contact terminal for an electrical connector used for coupling modular electrical wiring to an electrical fixture. The terminal 400 includes many or all of the features previously described in relation to the terminals 100, 200, and 300. As such, just certain aspects of the terminal 400 will hereinafter be described for the sake of brevity.

As shown, the terminal 400 includes a first spring contact 410A extending from the base 408 into the central cavity 414, and a second spring contact 410B extending from sidewall 404 into the central cavity 414. Similarly, a third spring contact 412A extends from the base 408 into the central cavity 414, and a fourth spring contact 412B extends from sidewall 406. In some embodiments, the first spring contact 410A and the third spring contact 412A are arranged side-by-side, separated by a first slot 426. The first spring contact 410A and the third spring contact 412A may extend generally along the same plane, as shown, or may extend at different angles towards the base 408 relative to one another to accommodate for different wire sizes and or varied gripping force. The second spring contact 410B and the fourth spring contact 412B are similarly arranged side-by-side, and separated by a second slot 428. The second spring contact 410B and the fourth spring contact 412B may extend generally along the same plane, as shown, or may extend at different angles into the central cavity 414 relative to one another. The first and second slots 426, 428 permit individual movement/operation of each pair of spring contacts 410A-B and 412A-B.

In this embodiment, the second and fourth spring contacts 410B, 412B extend from respective upper walls 438, 440, which may extend from shoulder sections 432, 434 of the opposing sidewalls 404, 406. As shown, the second and fourth spring contacts 410B, 412B may extend downwards from upper walls 438, 440, wherein free ends 444, 446 are cantilevered with respect to the upper walls 438, 440 and/or shoulder sections 432, 434. In the non-limiting embodiment shown, the free ends 444, 446 may have a serrated edge and/or a sharpened surface to increase a gripping force on a wire inserted between the pairs of spring contacts 410A-B and 412A-B.

Although not shown, the embodiments described and/or illustrated herein may provide electrical spring connectors having an actuator for securing and/or releasing the wire from the electrical spring contacts. The embodiments described and/or illustrated herein may provide electrical spring connectors having an actuator for releasing an electrical wire from an electrical contact, wherein the actuator can be actuated using a tool (e.g., an instrument, a pen, a wire, a rod, and/or the like), using a body part (e.g., a person's finger, thumb, and/or the like), and/or the like.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, the present disclosure has been described herein in the context of a particular implementation in a particular environment for a particular purpose. Those of ordinary skill in the art will recognize the usefulness is not limited thereto and the present disclosure may be beneficially implemented in any number of environments for any number of purposes. Thus, the claims set forth below are to be construed in view of the full breadth and spirit of the present disclosure as described herein.

What is claimed is:

1. A wire spring terminal comprising:

a main contact body having a base and a set of sidewalls defining a central cavity, the set of sidewalls oriented substantially perpendicularly to the base;

a first spring contact extending from the base into the central cavity; and a second spring contact extending from one of the set of sidewalls into the central cavity at an angle towards the base, the first and second spring contacts configured to engage a wire inserted into the central cavity.

2. The wire spring terminal of claim 1, further comprising a connection member extending outwardly from an end of the main contact body, the connection member comprising:

a tubular section; and a neck region connecting the tubular section to a tongue of the main contact body, wherein the tongue extends from the base.

3. The wire spring terminal of claim 2, further comprising a support member extending between the tubular section and the tongue.

4. The wire spring terminal of claim 2, the connection member further comprising an end cap extending from the tubular section.

5. The wire spring terminal of claim 1, further comprising a shoulder region extending directly from an upper end of the one of the set of sidewalls, wherein the second spring contact extends directly from the shoulder region.

6. The wire spring terminal of claim 1, the second spring contact comprising:

an upper wall extending from the one of the set of sidewalls, the upper wall oriented substantially parallel to the base of the main contact body; and a free end portion extending from the upper wall at an angle into the central cavity.

7. The wire spring terminal of claim 1, further comprising an opening formed through the base of the main contact body, wherein the first spring contact extends from one edge of the opening at an angle into the central cavity.

8. The wire spring terminal of claim 1, further comprising:

a third spring contact extending from the base into the central cavity; and a fourth spring contact extending from another one of the set of sidewalls into the central cavity, the third and fourth spring contacts configured to engage a second wire.

9. The wire spring terminal of claim 8, wherein the first spring contact and the third spring contact are arranged side-by-side, and wherein the second spring contact and the fourth spring contact are arranged side-by-side.

10. The wire spring terminal of claim 8, wherein the second spring contact has a different length than the fourth spring contact.

11. A wire spring terminal comprising:

a main contact body having a base and a set of sidewalls defining a central cavity, the set of sidewalls oriented substantially perpendicularly to the base;

a first spring contact extending from the base into the central cavity; and a second spring contact extending directly from an upper end of one of the set of sidewalls into the central cavity at an angle towards the base, the first and second spring contacts configured to engage a wire inserted into the central cavity.

12. The wire spring terminal of claim 11, further comprising a connection member extending outwardly from an end of the main contact body, the connection member comprising:

a tubular section;

a neck region connecting the tubular section to a tongue of the main contact body, wherein the tongue extends from the base; and a support member extending between the tubular section and the tongue.

13. The wire spring terminal of claim 12, the connection member further comprising an end cap extending from the tubular section.

14. The wire spring terminal of claim 11, further comprising:

a shoulder region extending from the upper end of one of the set of sidewalls;

an upper wall extending from the one of the set of sidewalls, wherein the upper wall is oriented substantially parallel to the base of the main contact body, and wherein the upper wall is oriented substantially perpendicular to the one of the set of sidewalls; and a free end portion cantilevered from the upper wall at an angle into the central cavity.

15. The wire spring terminal of claim 11, further comprising an opening formed through the base of the main contact body, wherein the first spring contact extends from one edge of the opening at an angle into the central cavity.

16. The wire spring terminal of claim 11, further comprising:

a third spring contact extending from the base into the central cavity; and a fourth spring contact extending from another one of the set of sidewalls into the central cavity, wherein the first spring contact and the third spring contact are arranged side-by-side, and wherein the second spring contact and the fourth spring contact are arranged side-by-side and having different lengths.

17. A wire spring terminal for an electrical connector, the wire spring terminal comprising:

a main contact body having a base and a set of sidewalls defining a central cavity, the sidewalls oriented substantially perpendicularly to the base;

a first spring contact extending from the base into the central cavity; and a second spring contact extending from one of the set of sidewalls into the central cavity at an angle towards the base, the first and second spring contacts configured to engage a wire inserted into the central cavity, wherein the second spring contact comprises:

a shoulder region extending from an upper end of the one of the set of sidewalls;

an upper wall extending from the one of the set of sidewalls, wherein the upper wall is oriented substantially parallel to the base of the main contact body, and wherein the upper wall is oriented substantially perpendicular to the one of the set of sidewalls; and a free end portion cantilevered from the upper wall at an angle into the central cavity.

18. The wire spring terminal of claim 17, wherein the first spring contact extends from an edge of an opening formed through the base of the main contact body.

19. The wire spring terminal of claim 17, further comprising a connection member extending outwardly from an end of the main contact body, the connection member comprising:

a tubular section;

a neck region connecting the tubular section to a tongue of the main contact body, wherein the tongue extends from the base; and a support member extending between the tubular section and the tongue.

20. The wire spring terminal of claim 19, wherein the support member includes a stiffening feature extending from a first section of the tongue, across the neck region, and into the tubular section.

* * * * *